United States Patent [19]

Szostak et al.

[11] Patent Number: 4,497,267

[45] Date of Patent: Feb. 5, 1985

[54] LOW TORQUE PATTERN SELECTING MECHANISM FOR A SEWING MACHINE

[75] Inventors: Jan Szostak, Lincroft; Henry Schaeflern, Pittstown; Walter H. W. Marsh, Scotch Plains, all of N.J.

[73] Assignee: The Singer Company, Stamford, Conn.

[21] Appl. No.: 590,932

[22] Filed: Mar. 19, 1984

[51] Int. Cl.[3] ..... D05B 3/02

[52] U.S. Cl. ..... 112/158 A

[58] Field of Search ..... 112/158 A, 158 D

[56] References Cited

U.S. PATENT DOCUMENTS 3,256,843 6/1966 Akira .
3,699,910 10/1972 Urciola et al. .
3,786,769 1/1974 Coulombe .
4,170,950 10/1979 Ozaki .
4,184,440 1/1980 Matsumoto .
4,301,754 11/1981 Suzaki et al. ..... 112/158 A
4,408,553 10/1983 Mihovch et al. ..... 112/158 A
4,428,311 1/1984 Sano ..... 112/158 A

*Primary Examiner*—Werner H. Schroeder
*Assistant Examiner*—Andrew M. Falik
*Attorney, Agent, or Firm*—William V. Ebs; Robert E. Smith; Edward L. Bell

[57] ABSTRACT

A pattern selecting dial for a sewing machine is connected through a toothed driving belt to a remotely located rotatable member which carries a circularly arranged stepped cam and which can be turned with the application of low torque to the dial to effect the selective positioning of a cam follower opposite a pattern controlling cam stack.

7 Claims, 4 Drawing Figures

LOW TORQUE PATTERN SELECTING MECHANISM FOR A SEWING MACHINE

BACKGROUND OF THE INVENTION

1. Field of the Invention

The invention is directed to pattern selecting mechanism for sewing machines.

2. Description of the Prior Art

It is well known for a sewing machine to include a plurality of pattern cams in a stack with respect to which a cam follower may be positioned by an operator to control a machine operation such as needle jogging. Such a machine may be seen, for example, in U.S. Pat. No. 3,786,769 of Lionel J. Coulombe for "Pattern Selection System" and in U.S. Pat. No. 3,699,910 of John A. Urciola and Walter H. Marsh for "Cam Selector Mechanism for Sewing Machines." Pattern selecting mechanisms as provided heretofor have included an operator's control in the form of a vertical axis dial having only a small hands on portion that projected through the casing of a sewing machine as in the manner shown in the said U.S. Pat. No. 3,786,769, or have included a pivoted control lever as shown in U.S. Pat. No. 3,699,910 for use in imparting linear movement to a stepped cam which served to position a cam follower with respect to pattern controlling cams. In either case, considerable local pressure had to be executed by an operator on the control instrumentality when selecting a pattern to be sewn on a machine.

It is a prime object of the present invention to provide a sewing machine with improved pattern selecting mechanism enabling an operator to selectively position a follower along a stack of pattern controlling cams with the application of low torque to a remotely located rotatable dial.

It is another object of the invention to provide improved pattern selecting mechanism as described including improved force amplifying linkage means operable by the dial for disposing the follower apart from the cam stack during movement of the follower between cams thereon.

It is still another object of the invention to provide improved pattern selecting mechanism as described including a linearly movable pattern selection indicator operable by the dial.

Other object and advantages of the invention will become apparent during a reading of the specification taken in conjunction with the accompanying drawings.

SUMMARY OF THE INVENTION

Pattern selecting mechanism for a sewing machine is provided with a rotatable pattern selecting dial, a vertical stack of rotatable pattern controlling cams, a cam follower, a fixed shaft having the follower pivotally and slidably mounted thereon, and a circularly arranged stepped cam rotatable about said axis for lifting the follower into positions to engage different ones of the pattern controlling cams as defined by the rotational position of the stepped cam. An operable connection between the dial and said stepped cam enabling an operator to position the stepped cam by turning the dial includes a vertical axis gear rotatable by the dial, a gear with the stepped cam thereon having a diameter greater than the diameter of the vertical axis gear, and a toothed driving belt engageable with the vertical axis gear and toothed periphery of the cam carrying gear. The cam follower while being lifted by the stepped cam is disposed apart from the pattern cams by dial operated mechanism including linkage means fulcrumed to amplify force applied thereto by operation of the dial.

DESCRIPTION OF THE PREFERRED EMBODIMENT

Figure 1:
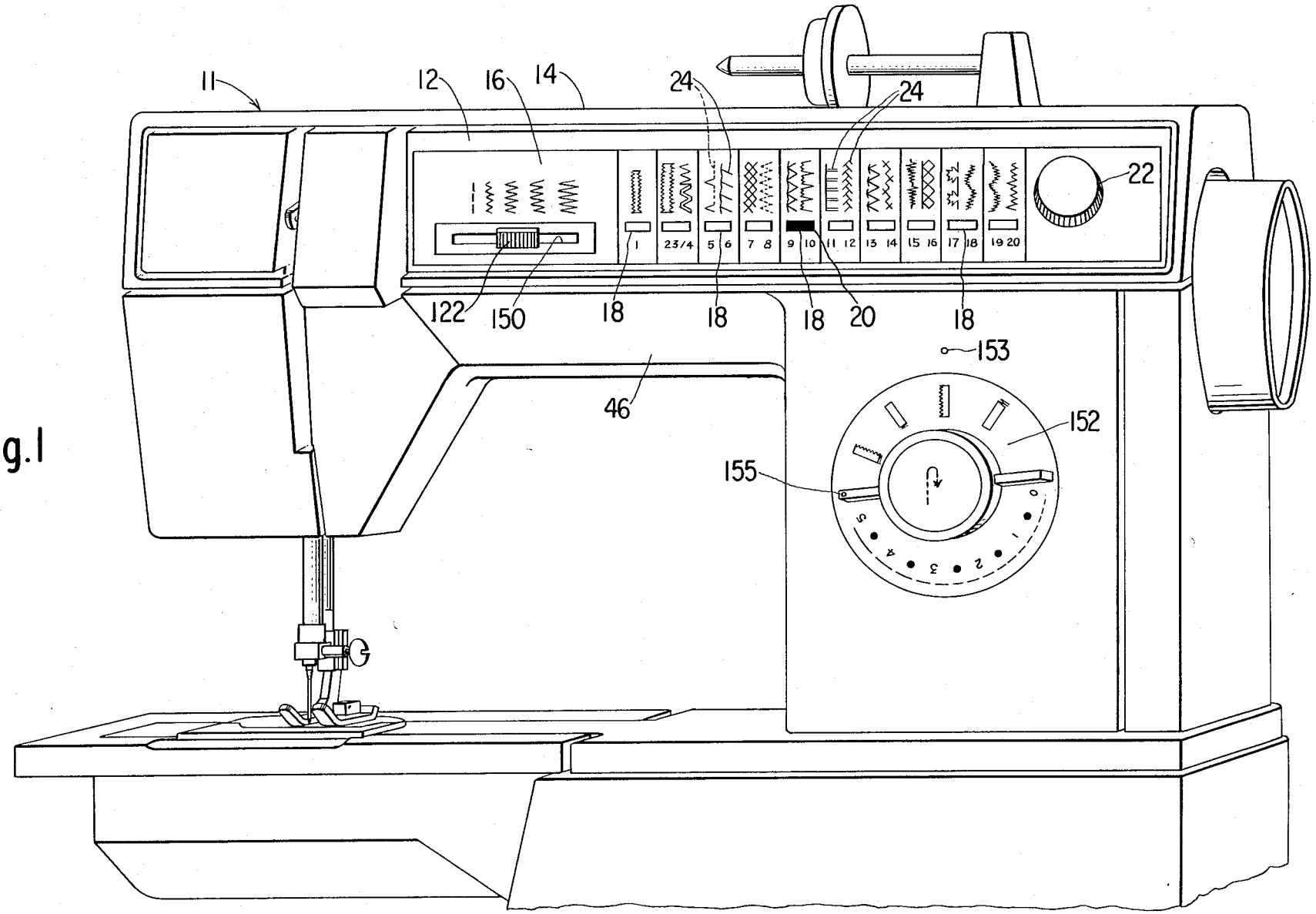
FIG. 1 is a front perspective view of a sewing machine according to the invention.

Referring to the drawings, reference character 11 designates a sewing machine which is provided on the front face 12 of a top cover 14 with a pattern indicating panel 16. The panel includes a number of windows 18 into any one of which an operator may position a slider 20 with knob 22 to select a pattern 24, as represented above the window to be sewn on the machine.

Knob 22 and a pulley 26 are mounted on a rotatably supported shaft 28 so as to enable an operator to impart rotation to the pulley by turning the knob. A string 30 extends about the pulley and over guides 32 and 34 to connect at opposite ends to a coil spring 36. Slider 20 is secured to the string at 38. When pulley 26 is turned with knob 22, the slider is caused to slide along a supporting surface 40 on the front face plate 42 of a frame 44 which is secured to the machine structure 46 with screws 48, 49 and 50 extending through a bottom plate portion 52 of the frame.

Shaft 28 is rotatably supported in a bushing 54 located in an opening 56 in front face plate 42, and has a bevel gear 58 affixed thereto on the opposite side of the face plate from pulley 26 for rotation by knob 22. Bevel gear 58 is meshed with another bevel gear 60 which is rotatably mounted on a stub shaft 62 that is secured to the bottom plate 52 of frame 44 with an E-clamp 66. Bevel gear 60 is integral with a gear 68 having a hexagonal hub 70 which supports a link actuating star wheel 72 for rotation with the gears.

Gear 68 is engaged by the teeth 74 of a flexible belt 76 which extends to a location remote from knob 22 to engage the teeth 78 of a gear 80 having a cylindrical stepped cam 82 formed thereon, as shown. Gear 80 is rotatably mounted on a shaft 84 between a C-clamp 86 and a kick-out link 88 which is pivotally supported at opening 90 on the shaft. An enlarged diameter portion 92 of the shaft engages the underside of the link, and a threaded end portion 94 of the shaft extends through the bottom plate 52 of frame 44. The shaft is held fast to frame 44 with a nut 200 on threaded portion 94. Part of the threaded portion extends under the nut for use as a locator in the machine structure.

Reference character 98 designates a rotatable stack of pattern cams, the individual cams of which are used to control the sewing of patterns on the machine. The cam stack is driven by the arm shaft 97 of the machine through a worm 99 and worm wheel 100. A cam follower 102 is provided for the cam stack 98. Such cam follower is mounted at 104 for pivotal and axial movement on shaft 84. A pin 106 is affixed in the follower. The pin is threaded at 107 into the follower arm 108 to permit adjustment, and is secured thereto with a locking nut 110. The cam follower is biased downwardly into a position of engagement between pin 106 and stepped cam 82 by a helical spring 112 located under a pronged washer 114 which is secured to shaft 84 with a screw 116. The spring is hooked at opposite ends 118 and 120 onto washer 114 and follower arm 108, respectively, and also biases the follower about the axis of shaft 84 in a direction away from cam stack 98.

Figure 2:
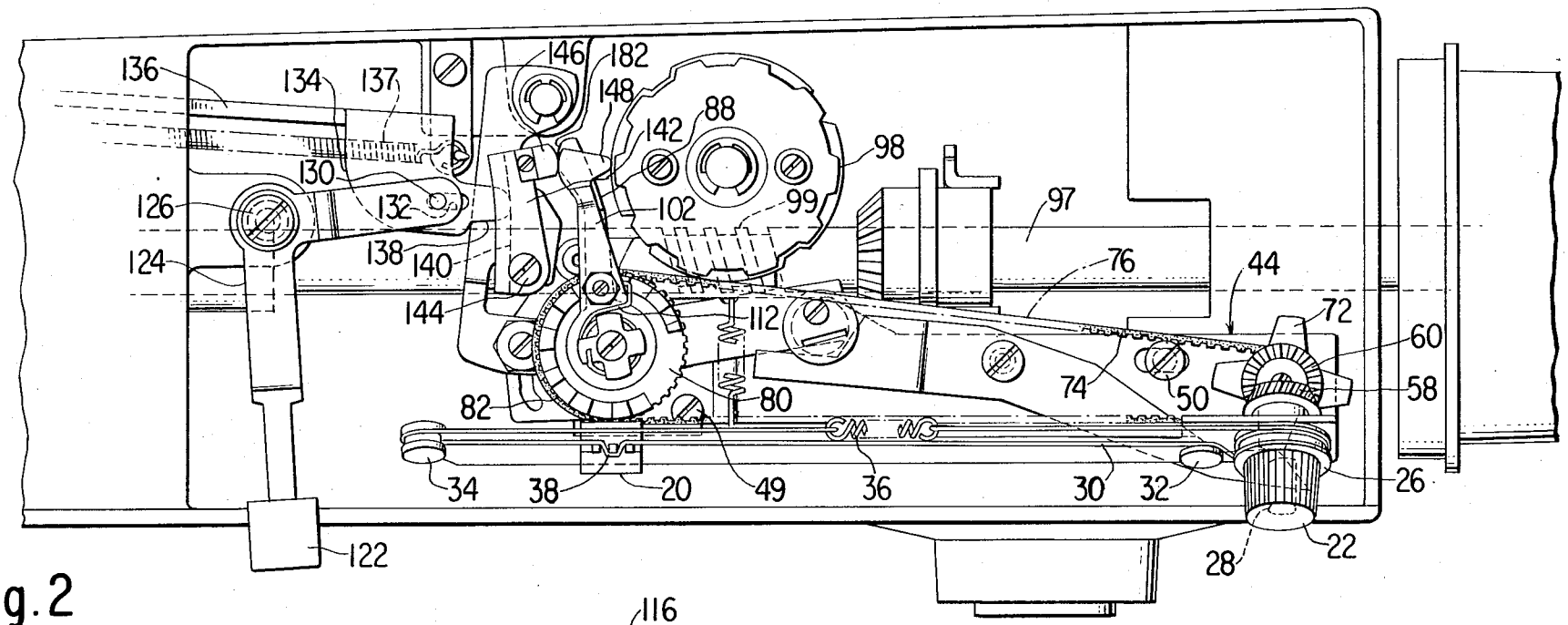
FIG. 2 is a top plan view of the machine with the top cover plate removed to show the pattern selecting mechanism of the invention.
Figure 3:
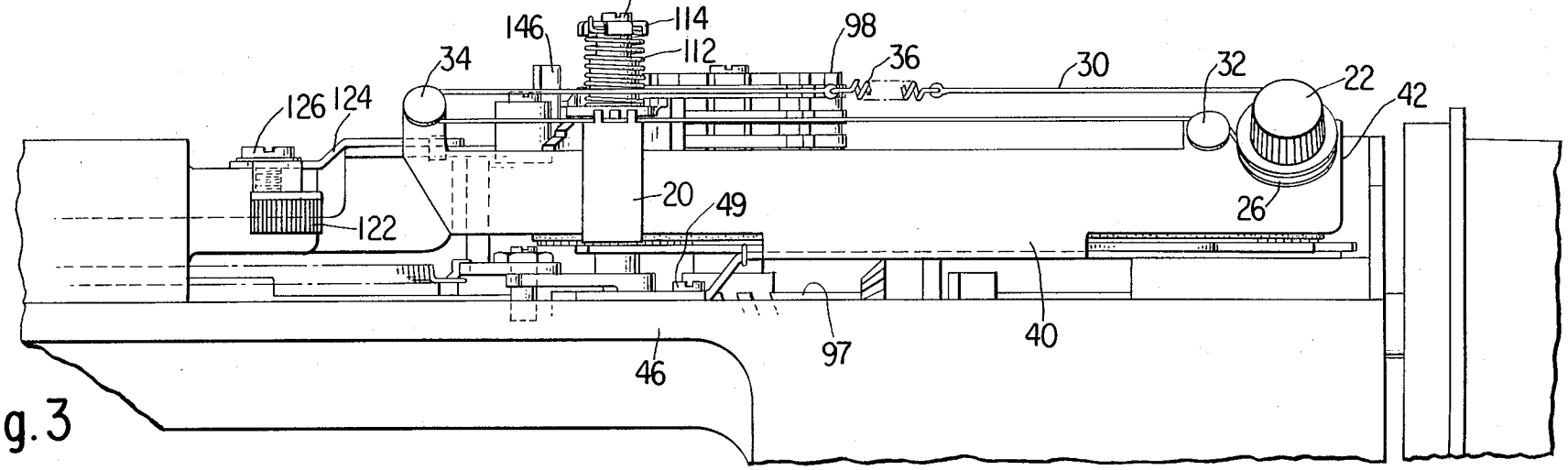
FIG. 3 is a front elevational view of said sewing machine with the top cover plate removed.
Figure 4:
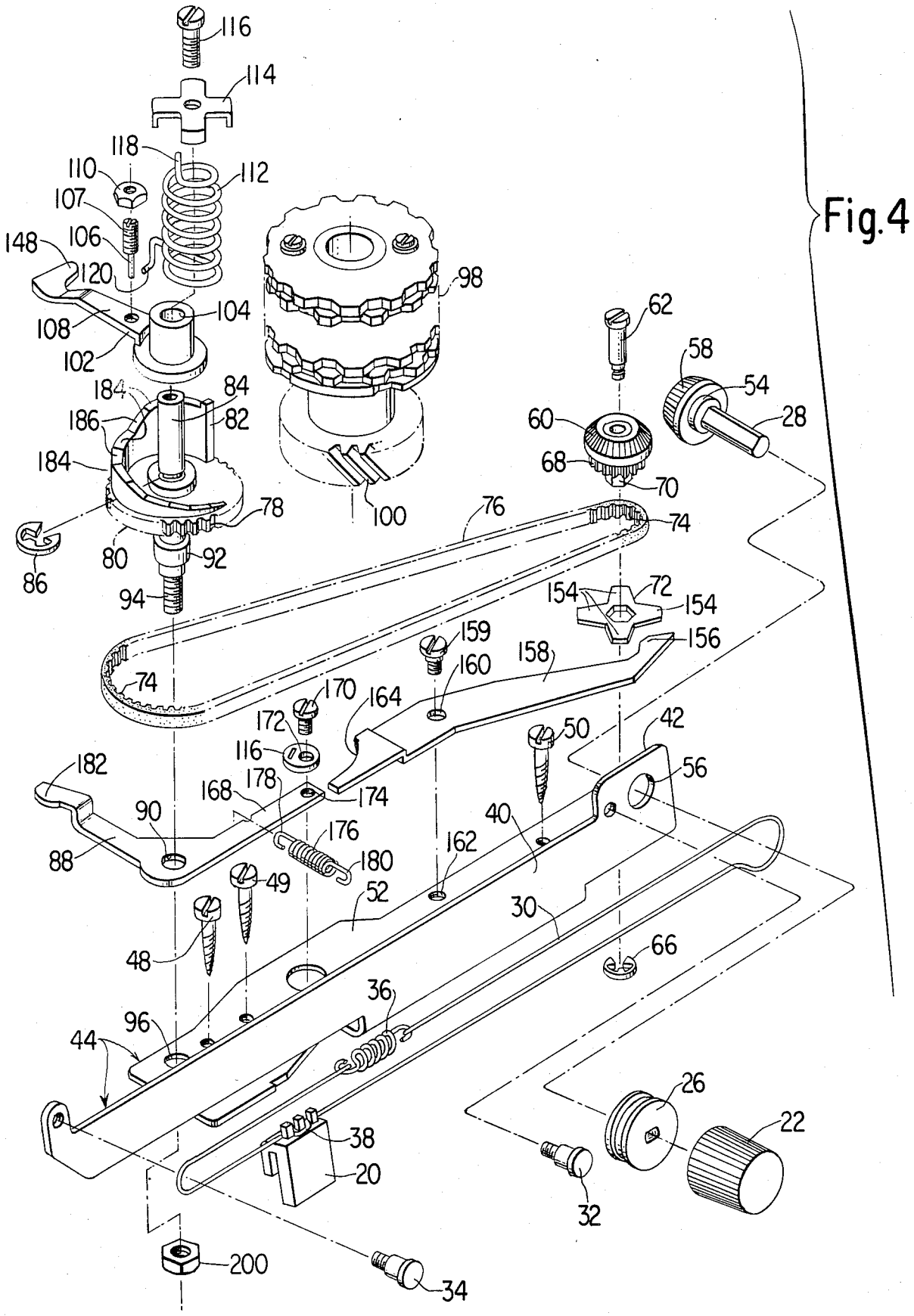
FIG. 4 is an exploded perspective view showing the mechanism of the invention.

A bight regulating lever 122 is operable to move cam follower 102 into engagement with cam stack 98. Lever 122 is an extension of a bell crank 124 which is pivoted at 126 in the machine. The bell crank carries a pin 130 which is slidable in a slot 132 located in a flanged portion 134 of a link 136 that is biased rightwardly as viewed in FIG. 2 by a strong spring 137 toward a position of engagement in the left end of slot 132 with pin 130. Link 136 serves to transmit zig zag jogging movements to a conventional needle bar gate (not shown) as used in known varieties of zig zag sewing machines. The flanged portion 134 of link 136 terminates in a finger 138 which engages a track 140 in a lever 142 pivoted at 144 in the machine. Counterclockwise movement of lever 122 and bell crank 124 into a position as shown in FIG. 2 is accompanied by the enforced movement of lever 142 by finger 138, and the lever 142 acting through an appendage 146 disposes the cam follower 102 at end 148 against cam stack 98. An engaged cam of the cam stack actuates the follower during rotation of the cam stack and the follower moves lever 142 which in turn transmits bight controlling movements, of a magnitude depending upon the particular position of lever 122, to link 136. Clockwise movement of lever 122 to the left end of slot 150 in panel 16 results in follower 102 being undisturbed by the cam stack by the action of spring 112.

Cam follower 102 may be positioned opposite any cam of cam stack 98 by the operation of knob 22. When knob 22 is turned to position slider 20 in a particular window, as shown for example in FIG. 1, cam follower 102 is moved by stepped cam 82 acting through pin 106 opposite a cam of cam stack 98 enabling one or another of the stitches represented above the window to be produced on the machine once a feed regulating dial 152 has also been positioned as required for the particular stitch which is to be produced on the machine. Buttonholes, as indicated at windows 1 and 2, require the sequential alignment of the buttonhole sigments on the dial with a mark 153 on the standard portion of the machine structure 46. Certain of the other patterns above the windows, as would be indicated in an instruction manual, require cam controlled feeding of the work provided for by placement of the dial 152 in a position wherein a mark 155 on the dial is aligned with mark 153. Cam controlled feeding is discontinued for the remaining patterns by moving the dial out of the position of alignment for marks 153 and 155, and into a desired stitch length selecting position wherein a graduated part of the dial is disposed opposite mark 153. Dial 152 is operatively connected with the usual feed regulating mechanism through conventional buttonhole controlling cams, a feed controlling cam and stitch length controlling mechanism which may be of the kind shown, for example, in U.S. Pat. No. 3,636,900 of Frederick Rogers et al for "Control Device for the Work Feeding Mechanism of a Sewing Machine", issued Jan. 25, 1972.

Whenever slider 20 is in a window, star wheel 72 having four symmetrically disposed fingers 154 ninety degrees apart thereon, is disposed to receive the heel 156 of a link 158 between adjacent fingers. As shown, link 158 is pivotally mounted on a shouldered screw 159 extending through a hole 160 in the link and fastened in a threaded opening 162 in the bottom plate 52 of frame 44. A camming surface 164 at the end of link 158 is engaged by an eccentric member 116 which is adjustably secured to an arm 168 of kick-out link 88 by a screw 170 extending through a hole 172 on the eccentric member and into a threaded hole 174 in the arm. A spring 176 having hooked ends 178 and 180 in engagement with arm 168 of link 88 and bottom plate 52 biases link 88 against link 158, and so causes the heel 156 of link 158 to be biased against star wheel 72.

Star wheel 72 is turned through ninety degrees with a ninety degree turn of the knob 22 to cause the heel 156 of link 158 to ride up and down one of the fingers 154 of the wheel, and so move from a position between one pair of fingers to a new position on the wheel between adjacent fingers. Link 158 is pivoted about screw 159 which serves as a fulcrum for the link at a location assuring the operation thereof with an amplifying output to input force ratio. Kick-out link 88 is pivoted on shaft 84 in response to the movement of link 158, and if cam follower 102 is then being held against cam stack 98 by lever 142, appendage 146 on the lever is engaged by an end portion 182 of link 88, and the lever is moved away from cam stack 98 whereupon cam follower 102 is caused by spring 112 to follow lever 142 and move out of contact with the cam stack 98. Lever 142 is moved against the bias of spring 137 acting thereon through link 136. Pin 130 slides in slot 132 and the bight regulating lever is undisturbed.

Cam follower 102 is out of contact with cam stack 98 during fourty five degrees of each ninety degree rotational movement of star wheel 72 imparted thereto by knob 22, as described, and at such time stepped cam 82, which is rotated through gears 58, 60 and 68, belt 76, and gear 80 causes pin 106 in follower arm 108 to be moved either up or down on the cam, depending upon the direction in which the cam is rotated, that is from one flat 184 on the cam via an adjacent ramp 186 to the next flat. The cam follower is thereby moved from a position opposite one cam to a position opposite an adjacent cam. The cam follower is pivoted back into engagement with the cam stack by the action of spring 137 upon completion of a ninety degree rotational movement of star wheel 72. With the requisite number of ninety degree movements imparted to star wheel 72 by knob 22 and accompanying movements of the stepped cam, cam follower 102 can be caused to engage any cam in the cam stack.

It is to be understood that the present disclosure relates to a preferred embodiment of the invention which is for purposes of illustration only and is not to be construed as limiting the invention. Numerous alterations and modification of the structure herein will suggest themselves to those skilled in the art, and all such modification and alterations which do not depart from the spirit and scope of the invention are intended to be included within the scope of the appended claims.

We claim:

1. Pattern selecting mechanism for a sewing machine comprising a rotatable pattern selecting dial; a plurality of rotatable pattern controlling cams; a cam follower; a fixed shaft having the follower pivotally and slidably mounted thereon; a circularly arranged stepped cam rotatable about the axis of said shaft for lifting the follower into positions to engage different ones of the said cams as defined by the rotational position of the cam; an operable connection between the dial and stepped cam enabling an operator to position the stepped cam by turning the dial, said operable connection including a gear rotatably driven by the dial, another gear which carries the stepped cam and has a diameter greater than the diameter of said dial rotatable gear; and means operable by the dial for disposing the cam follower apart from the pattern cams while being lifted by the stepped cam, said means including linkage means fulcrumed to amplify the force applied thereto be the operation of the dial.

2. The combination of claim 1 including a linearly movable pattern selection indicator operably connected to the dial for movement thereby.

3. The combination of claim 1 wherein the steps of the circularly arranged cam are disposed to move the follower from one cam to another cam adjacent thereto when the dial is rotated ninety degrees.

4. The combination of claim 3 wherein the means operable by the dial for disposing the cam follower apart from the pattern cams includes an actuator for the linkage means, the actuator being rotatable by the dial and having spaced apart fingers thereon for successively engaging the linkage means during rotation of the dial.

5. The combination of claim 4 wherein the actuator fingers are ninety degrees apart one from the other.

6. The combination of claim 1 wherein the linkage means includes a pair of cam connected motion transmitting links.

7. The combination of claim 1 wherein the means for disposing the cam follower apart from the pattern cams includes an actuator for the linkage means, and the linkage means includes a pair of cam connected motion transmitting links one of which is engaged by the actuator.

* * * * *